US012115407B1

(12) United States Patent
Norris

(10) Patent No.: US 12,115,407 B1
(45) Date of Patent: Oct. 15, 2024

(54) DUMBBELL HAVING A THREADED CONNECTION FOR ADDING WEIGHT PLATES

(71) Applicant: Andrew Norris, Peru, IN (US)

(72) Inventor: Andrew Norris, Peru, IN (US)

( * ) Notice: Subject to any disclaimer, the term of this patent is extended or adjusted under 35 U.S.C. 154(b) by 115 days.

(21) Appl. No.: 17/982,575

(22) Filed: Nov. 8, 2022

(51) Int. Cl.
*A63B 21/072* (2006.01)
*A63B 21/075* (2006.01)

(52) U.S. Cl.
CPC ..... *A63B 21/0728* (2013.01); *A63B 21/0724* (2013.01); *A63B 21/075* (2013.01)

(58) Field of Classification Search
CPC ..... A63B 21/0724; A63B 21/0728; A63B 21/075
See application file for complete search history.

(56) References Cited

U.S. PATENT DOCUMENTS 5,090,693 A 2/1992 Liang
5,484,367 A * 1/1996 Martinez ..... A63H 33/30 482/107
5,628,716 A * 5/1997 Brice ..... A63B 21/0728 482/106
6,875,161 B1 * 4/2005 Brice ..... A63B 21/0728 482/107
7,364,536 B2 4/2008 Cappellini
7,491,156 B1 2/2009 GaoYong
7,731,641 B1 * 6/2010 Chen ..... A63B 21/075 482/106
7,740,569 B2 6/2010 Patti
8,617,036 B2 * 12/2013 Chen ..... A63B 21/0728 482/106
D936,762 S 11/2021 Ye
11,364,407 B2 * 6/2022 Jones ..... A63B 21/0728
11,458,348 B1 * 10/2022 Wang ..... A63B 21/0722
2005/0143229 A1 6/2005 Marr
2006/0105891 A1 * 5/2006 Cappellini ..... A63B 21/0726 482/106
2006/0172871 A1 * 8/2006 Cao ..... A63B 21/075 482/106
2009/0239719 A1 * 9/2009 Patti ..... A63B 21/0726 482/107
2009/0270233 A1 10/2009 Cao

FOREIGN PATENT DOCUMENTS

EP 2044979 4/2009

* cited by examiner

*Primary Examiner* — Joshua Lee
(74) *Attorney, Agent, or Firm* — Kyle A. Fletcher, Esq.

(57) ABSTRACT

A dumbbell having a threaded connection for adding weight plates. The dumbbell is a resistance training device. The dumbbell is configured for use in resistance exercise. The dumbbell comprises a center shaft, a plurality weight plates, a plurality of collar plates, and a plurality of end caps. The plurality weight plates, the plurality of collar plates, and the plurality of end caps attach to the center shaft. The plurality of collar plates and the plurality of end caps secure the plurality weight plates into a fixed position on the center shaft. The center shaft, the plurality weight plates, the plurality of collar plates, and the plurality of end caps are interconnected using threaded connections.

13 Claims, 5 Drawing Sheets

DUMBBELL HAVING A THREADED CONNECTION FOR ADDING WEIGHT PLATES

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of dumbbells and barbells. (A63B21/0728)

SUMMARY OF INVENTION

The dumbbells with threaded weight fastening member is a resistance training device. The dumbbells with threaded weight fastening member is configured for use in resistance exercise. The dumbbells with threaded weight fastening member comprises a center shaft, a plurality weight plates, a plurality of collar plates, and a plurality of end caps. The plurality weight plates, the plurality of collar plates, and the plurality of end caps attach to the center shaft. The plurality of collar plates and the plurality of end caps secure the plurality weight plates into a fixed position on the center shaft. The center shaft, the plurality weight plates, the plurality of collar plates, and the plurality of end caps are interconnected using threaded connections.

These together with additional objects, features and advantages of the dumbbells with threaded weight fastening member will be readily apparent to those of ordinary skill in the art upon reading the following detailed description of the presently preferred, but nonetheless illustrative, embodiments when taken in conjunction with the accompanying drawings.

In this respect, before explaining the current embodiments of the dumbbells with threaded weight fastening member in detail, it is to be understood that the dumbbells with threaded weight fastening member is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the dumbbells with threaded weight fastening member.

It is therefore important that the claims be regarded as including such equivalent construction insofar as they do not depart from the spirit and scope of the dumbbells with threaded weight fastening member. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
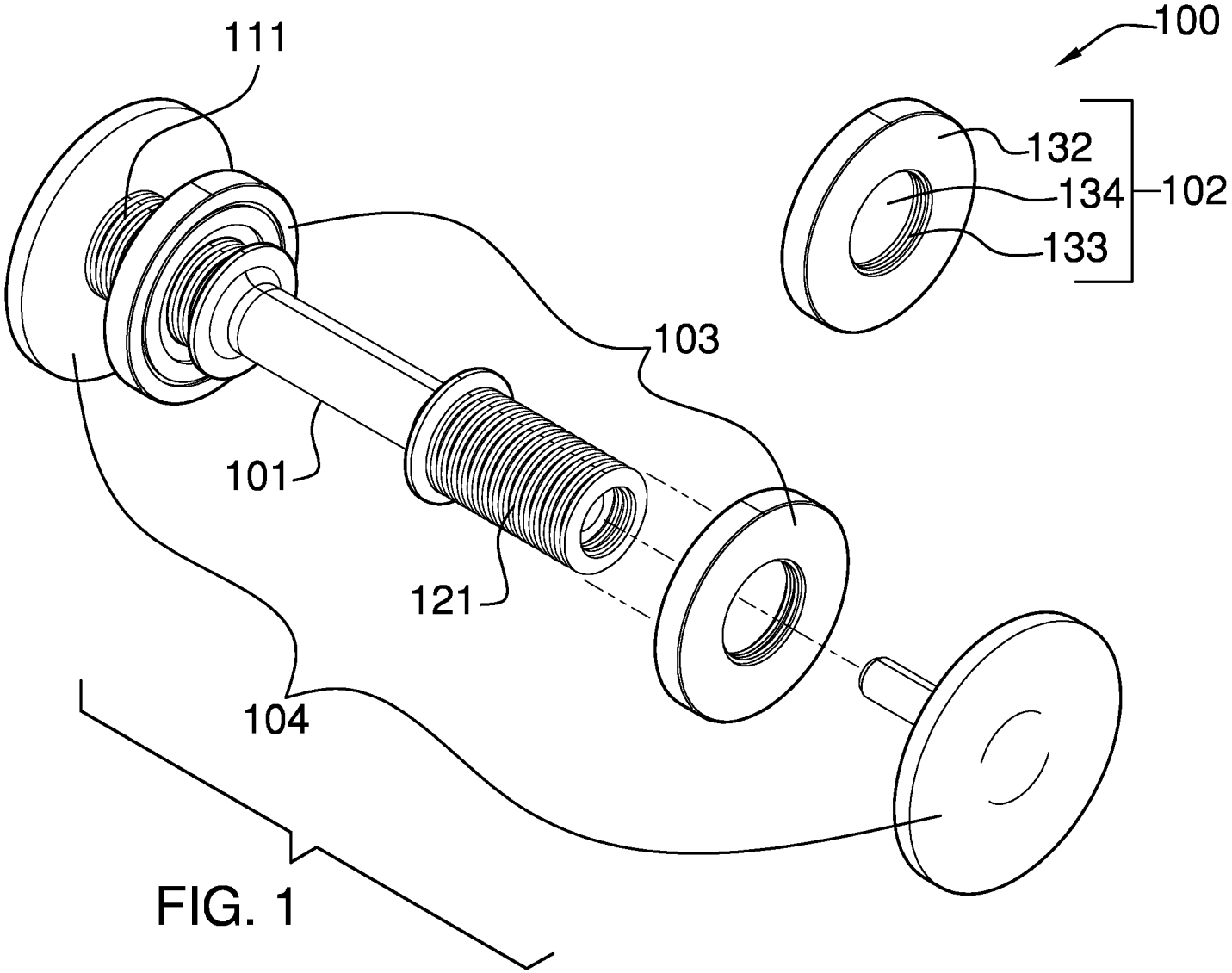
FIG. 1 is a perspective view of an embodiment of the disclosure.
Figure 2:
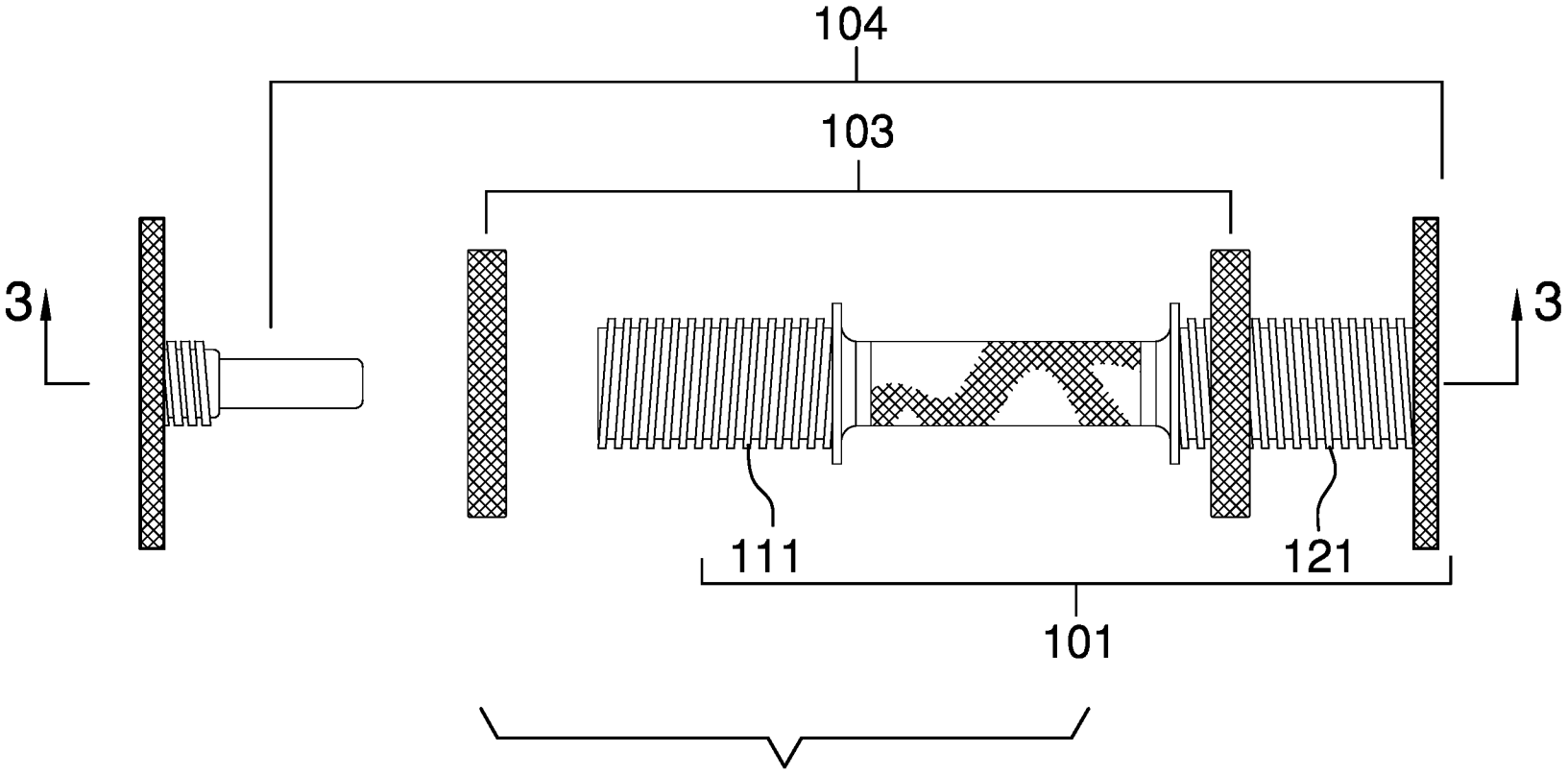
FIG. 2 is a front view of an embodiment of the disclosure.
Figure 3:
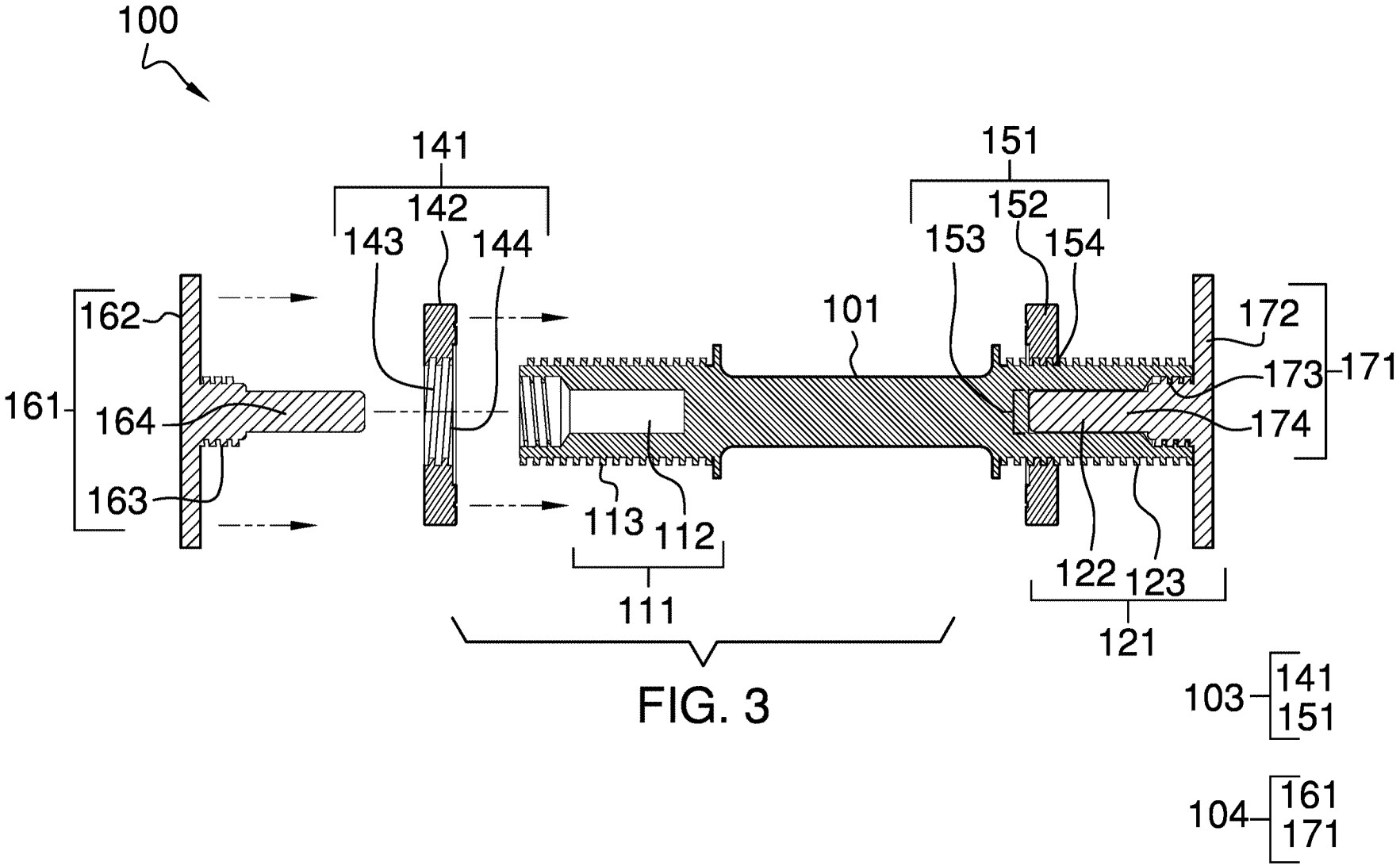
FIG. 3 is a cross-sectional view of an embodiment of the disclosure across 3-3 as shown in FIG. 2.
Figure 4:
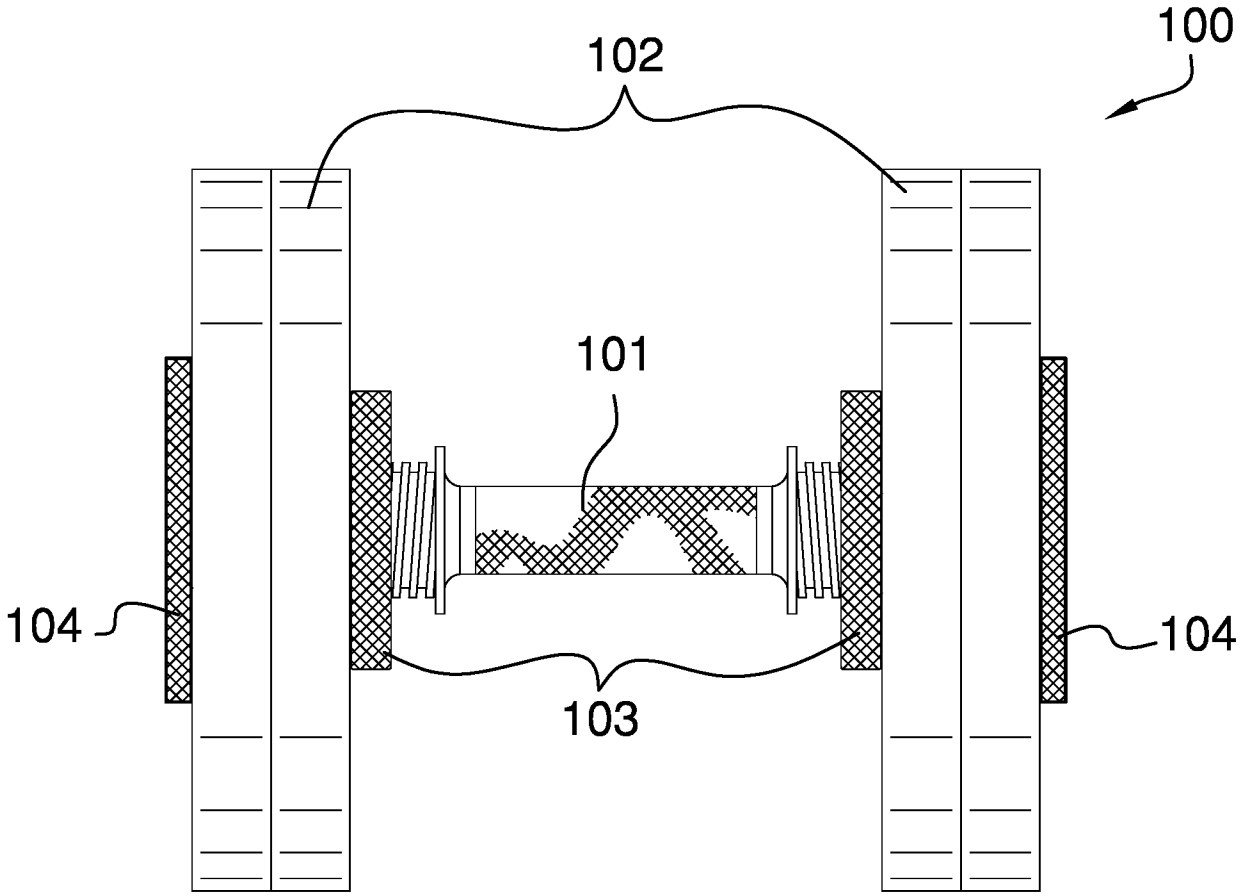
FIG. 4 is an in-use view of an embodiment of the disclosure.
Figure 5:
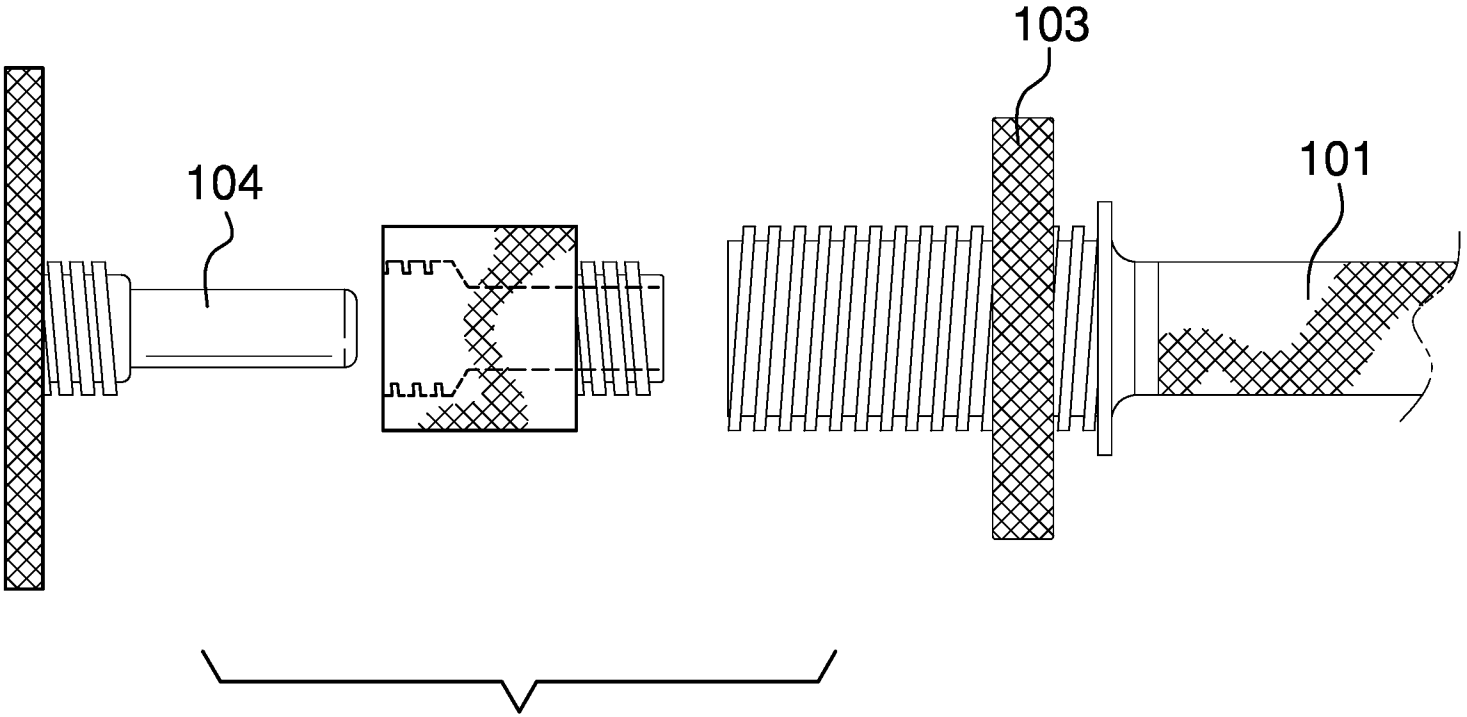
FIG. 5 is an exploded view of an alternate embodiment of the disclosure.

Detailed reference will now be made to one or more potential embodiments of the disclosure, which are illustrated in FIGS. 1 through 5.

The dumbbells with threaded weight fastening member 100 (hereinafter invention) is a resistance training device. The invention 100 is configured for use in resistance exercise. The invention 100 comprises a center shaft 101, a plurality of weight plates 102, a plurality of collar plates 103, and a plurality of end caps 104. The plurality of weight plates 102, the plurality of collar plates 103, and the plurality of end caps 104 attach to the center shaft 101. The plurality of collar plates 103 and the plurality of end caps 104 secure the plurality of weight plates 102 into a fixed position on the center shaft 101. The center shaft 101, the plurality of weight plates 102, the plurality of collar plates 103, and the plurality of end caps 104 are interconnected using threaded connections.

The center shaft 101 is a prism shaped structure. The center shaft 101 is a rigid structure. The center shaft 101 is a load bearing structure. The center shaft 101 forms a handle used to carry and manipulate the invention 100. The center 9 shaft 101 comprises a first congruent end 111 and a second congruent end 121. The first congruent end 111 further 11 comprises a first interior screw thread 112 and a first exterior screw thread 113. The second congruent end 121 further 13 comprises a second interior screw thread 122 and a second 14 exterior screw thread 123.

The first congruent end 111 is a congruent end of the prism structure of the center shaft 101. The first interior screw 17 thread 112 is a prism shaped negative space that is formed in the first congruent end 111. The first interior screw thread 19 forms a composite prism structure within the center shaft 101. The first exterior screw thread 113 is a helical structure that is formed on the lateral face of the prism structure of the center shaft 101. The first exterior screw thread 113 aligns with the first congruent end 111 of the center shaft 101.

The second congruent end 121 is a congruent end of the prism structure of the center shaft 101. The second interior screw thread 122 is a prism shaped negative space that is formed in the second congruent end 121. The second interior screw thread 122 forms a composite prism structure within the center shaft 101. The second exterior screw thread 123 is a helical structure that is formed on the lateral face of the prism structure of the center shaft 101. The second exterior screw 8 thread 123 aligns with the second congruent end 121 of the 9 center shaft 101.

The plurality of weight plates 102 comprises a collection of individual weight plates 131. Each individual weight plate 131 selected from the plurality of weight plates 102 is a disk shaped structure. Each selected individual weight plate 131 is a rigid structure. The selected individual weight plate 131 forms a mass that provides the counterforce (against the force of gravity) used for resistance training. Each individual weight plate 131 selected from the plurality of weight plates 102 is a ring shaped structure. Each selected individual weight plate 131 slides onto the center shaft 101. Each selected individual weight plate 131 forms an interchangeable mass that attaches to the center shaft 101. The use of the plurality of weight plates 102 allows the mass of the resistance provided by the invention 100 to be adjusted. Each selected individual weight plate 131 is further defined with a plate ring 132.

The plate ring 132 forms the disk structure of the selected individual weight plate 131. The plate ring 132 is a rigid structure. The plate ring 132 has a ring shape. The plate ring 132 forms the mass of the selected individual weight plate 131. The plate ring 132 screws onto a congruent end of the center shaft 101 selected from the group consisting of the first 8 congruent end 111 and the second congruent end 121. The plate 9 ring 132 further comprises a plate aperture 134. The plate aperture 134 is a prism shaped negative space that is formed through the congruent ends of the disk structure of the plate ring 132. The plate aperture 134 forms the negative space within the plate ring 132 that is characteristic of a ring 14 structure. The plate aperture 134 has a prism shaped negative space.

Each collar plate selected from the plurality of collar plates 103 is a disk shaped structure. Each selected collar plate is a rigid structure. The selected collar plate forms a physical barrier that prevents the plurality of weight plates 102 from shifting its position along the center shaft 101. Each collar plate selected from the plurality of collar plates 103 is a ring shaped structure. Each selected collar plate screws onto the center shaft 101. The plurality of collar plates 103 comprises a first collar plate 141 and a second collar plate 151.

The first collar plate 141 is a disk shaped structure. The first collar plate 141 is a rigid structure. The first collar plate 141 has a ring shape. The first collar plate 141 screws onto the first congruent end 111 of the center shaft 101. The first collar plate 141 forms a physical barrier that prevents an individual weight plate 131 from shifting its position along the 8 center shaft 101. The first collar plate 141 comprises a first collar plate 141 ring 142 and a first collar plate 141 aperture 143, and a first collar plate 141 interior screw thread 144. The first collar plate 141 interior screw thread 144 is formed in the first collar plate 141 aperture 143.

The first collar plate 141 ring 142 forms the disk structure of the first collar plate 141. The first collar plate 141 ring 142 is a rigid structure. The first collar plate 141 ring 142 has a ring shape. The first collar plate 141 ring 142 screws onto the first congruent end 111 of the center shaft 101. The first collar plate 141 ring 142 further comprises a first collar plate 141 aperture 143. The first collar plate 141 aperture 143 is a prism shaped negative space that is formed through the congruent ends of the disk structure of the first collar plate 141 ring 142.

The first collar plate 141 interior screw thread 144 is a helical structure that is formed on the lateral face of the prism structure of the negative space formed by the first collar plate 141 aperture 143. The first collar plate 141 interior screw thread 144 is sized such that the first collar plate 141 can screw directly onto the center shaft 101.

The second collar plate 151 is a disk shaped structure. The second collar plate 151 is a rigid structure. The second 8 collar plate 151 has a ring shape. The second collar plate 151 screws onto the second congruent end 121 of the center shaft 101. The second collar plate 151 forms a physical barrier that prevents an individual weight plate 131 from shifting its 12 position along the center shaft 101. The second collar plate 151 comprises a second collar plate 151 ring 152, a second collar plate 151 aperture 153, and a second collar plate 151 interior screw thread 154. The second collar plate 151 interior screw thread 154 is formed in the second collar plate 151 aperture 153.

The second collar plate 151 ring 152 forms the disk structure of the second collar plate 151. The second collar plate 151 ring 152 is a rigid structure. The second collar plate 151 ring 152 has a ring shape. The second collar plate 151 ring 152 screws onto the second congruent end 121 of the center shaft 101. The second collar plate 151 aperture 153 is a prism shaped negative space that is formed through the congruent ends of the disk structure of the second collar plate 151 ring 152.

The second collar plate 151 interior screw thread 154 is a helical structure that is formed on the lateral face of the prism structure of the negative space formed by the second collar plate 151 aperture 153. The second collar plate 151 interior screw thread 154 is sized such that the second collar plate 151 can screw directly onto the center shaft 101.

Each end cap selected from the plurality of end caps 104 is a composite prism structure. Each selected end cap is a rigid structure. The selected end cap forms a physical barrier that prevents the plurality of weight plates 102 from shifting off of the center shaft 101. Each end cap selected from the plurality of end caps 104 screws onto a congruent end of the center shaft 101. The plurality of end caps 104 comprises a first end cap 161 and a second end cap 171.

The first end cap 161 is a rigid structure. The first end cap 161 forms the physical barrier that prevents the individual weight plate 131 from shifting off of the first congruent end 111 of the center shaft 101. The first end cap 161 further comprises a first cap disk 162, a first cap fastener 163, and a first cap guide 164.

The first cap disk 162 is a disk shaped structure. The first cap disk 162 is a rigid structure. The span of the length of the outer diameter of the first cap disk 162 is greater than the span of the length of the outer diameter of the first congruent end 111 of the center shaft 101 such that the first cap disk 162 encloses the first congruent end 111.

The first cap fastener 163 is a prism shaped structure. The first cap fastener 163 attaches to a congruent end of the disk structure of the first cap disk 162. The first cap fastener 163 attaches to the first cap disk 162 to form a composite prism structure. The lateral face of the prism structure of the first cap fastener 163 is formed with an exterior screw thread. The first cap fastener 163 is sized such that the first cap fastener 163 forms a threaded connection with the first interior screw thread 112 of the first congruent end 111. The first cap fastener 163 screws the first end cap 161 to the first congruent end 111.

The first cap guide 164 is a prism shaped structure. The first cap guide 164 is a rigid structure. The first cap guide attaches to the congruent end of the prism structure of the first cap fastener 163 that is distal from the first cap disk 162. The first cap guide 164 attaches to the first cap fastener 163 to form a composite prism structure. The first cap guide 164 forms a leading structure that is used to guide the first end cap 161 into the first interior screw thread 112 of the first congruent end 111.

The second end cap 171 is a rigid structure. The second end cap 171 forms the physical barrier that prevents the individual weight plate 131 from shifting off of the second congruent end 121 of the center shaft 101. The second end cap 171 further comprises a second cap disk 172, a second cap fastener 173, and a second cap guide 174.

The second cap disk 172 is a disk shaped structure. The second cap disk 172 is a rigid structure. The span of the length of the outer diameter of the second cap disk 172 is greater than the span of the length of the outer diameter of the second congruent end 121 of the center shaft 101 such that the second cap disk 172 encloses the second congruent end 121.

The second cap fastener 173 is a prism shaped structure. The second cap fastener 173 attaches to a congruent end of the disk structure of the second cap disk 172. The second cap 17 fastener 173 attaches to the second cap disk 172 to form a 18 composite prism structure. The lateral face of the prism 19 structure of the second cap fastener 173 is formed with an exterior screw thread. The second cap fastener 173 is sized such that the second cap fastener 173 forms a threaded connection with the second interior screw thread 122 of the second congruent end 121. The second cap fastener 173 screws the second end cap 171 to the second congruent end 121.

The second cap guide 174 is a prism shaped structure. The second cap guide 174 is a rigid structure. The second cap guide attaches to the congruent end of the prism structure of the second cap fastener 173 that is distal from the second cap disk 172. The second cap guide 174 attaches to the second cap fastener 173 to form a composite prism structure. The second cap guide 174 forms a leading structure that is used to guide the second end cap 171 into the second interior screw thread 122 of the second congruent end 121.

The following three paragraphs describe the assembly details of the invention 100.

The first collar plate 141 interior screw thread 144 of the first collar plate 141 screws onto the first exterior screw thread 113 of the first congruent end 111 of the center shaft 101. The second collar plate 151 interior screw thread 154 of the second collar plate 151 screws onto the second exterior screw thread 123 of the second congruent end 121 of the center shaft 101.

Each individual weight plate 131 selected from the plurality of weight plates 102 slides onto the center shaft.

The first cap fastener 163 of the first end cap 161 screws into the first interior screw thread 112 of the first congruent end 111 of the center shaft 101. The second cap fastener 173 of the second end cap 171 screws into the second interior screw thread 122 of the second congruent end 121 of the center shaft 101.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Cant: As used in this disclosure, a cant is an angular deviation from one or more reference lines (or planes) such as a vertical line (or plane) or a horizontal line (or plane).

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Center of Rotation: As used in this disclosure, the center of rotation is the point of a rotating plane that does not move with the rotation of the plane. A line within a rotating three-dimensional object that does not move with the rotation of the object is also referred to as an axis of rotation.

Collar: As used in this disclosure, a collar is a ring like device that secures an object in a position.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Diameter: As used in this disclosure, a diameter of an object is a straight line segment (or a radial line) that passes through the center (or center axis) of an object. The line segment of the diameter is terminated at the perimeter or boundary of the object through which the line segment of the diameter runs. A radius refers to the line segment that overlays a diameter with one termination at the center of the object. A span of a radius is always one half the span of the diameter.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Extension Apparatus: As used in this disclosure, an extension apparatus is a mechanical structure that is used to extend or bridge the reach between any two objects.

Extension Structure: As used in this disclosure, an extension structure is an inert physical structure that is used to extend or bridge the reach between any two objects.

Exterior: As used in this disclosure, the exterior is used as a relational term that implies that an object is not contained within the boundary of a structure or a space.

Exterior Screw Thread: An exterior screw thread is a ridge wrapped around the outer surface of a tube in the form of a helical structure that is used to convert rotational movement into linear movement.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Helix: As used in this disclosure, a helix is the three-dimensional structure that would be formed by a wire that is wound uniformly around the surface of a cylinder or a cone. If the wire is wrapped around a cylinder the helix is called a cylindrical helix. If the wire is wrapped around a cone, the helix is called a conical helix. A synonym for conical helix would be a volute.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, the term inferior refers to a directional reference that is parallel to and in the same direction as the force of gravity when an object is positioned or used normally.

Inner Dimension: As used in this disclosure, the term inner dimension describes the span from a first inside or interior surface of a container to a second inside or interior surface of a container. The term is used in much the same way that a plumber would refer to the inner diameter of a pipe.

Interchangeable: As used in this disclosure, interchangeable refers to the ability to remove and replace an element of a structure. For example, if a first object that is attached to a structure can be removed and replaced with a second object selected from a plurality of compatible objects than the first object is said to be replaceable with both: 1) the second object; and, 2) each of the elements of compatible objects. Term interchangeable is commonly associated with tools. Interchangeable objects are often used to change the function or the performance characteristics of a tool.

Interior: As used in this disclosure, the interior is used as a relational term that implies that an object is contained within the boundary of a structure or a space.

Interior Screw Thread: An interior screw thread is a groove that is formed around the inner surface of a tube in the form of a helical structure that is used to convert rotational movement into linear movement.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Loop: As used in this disclosure, a loop is the length of a first linear structure including, but not limited to, shafts, lines, cords, or webbings, that is: 1) folded over and joined at the ends forming an enclosed space; or, 2) curved to form a closed or nearly closed space within the first linear structure. In both cases, the space formed within the first linear structure is such that a second linear structure such as a line, cord or a hook can be inserted through the space formed within the first linear structure. Within this disclosure, the first linear structure is said to be looped around the second linear structure.

Mass: As used in this disclosure, refers to a quantity of matter within a structure. Mass is measured and quantified by the reaction of the structure to a force. Mass can also be roughly quantified as a function of atomic composition and the number of atoms contained within the structure. The term weight refers to the quantification of a mass that is exposed to the force of gravity.

Negative Space: As used in this disclosure, negative space is a method of defining an object through the use of open or empty space as the definition of the object itself, or, through the use of open or empty space to describe the boundaries of an object.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan are open.

Perimeter: As used in this disclosure, a perimeter is one or more curved or straight lines that bounds an enclosed area on a plane or surface. The perimeter of a circle is commonly referred to as a circumference.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Radial: As used in this disclosure, the term radial refers to a direction that: 1) is perpendicular to an identified central axis; or, 2) projects away from a center point.

Reach: As used in this disclosure, reach refers to a span of distance between any two objects.

Rigid Structure: As used in this disclosure, a rigid structure is a solid structure formed from an inelastic material that resists changes in shape. A rigid structure will permanently deform as it fails under a force. See bimodal flexible structure.

Ring: As used in this disclosure, a ring is a term that is used to describe a disk-like structure through which a negative space is formed through the faces of the disk-like structure. Rings are often considered loops.

Rotation: As used in this disclosure, rotation refers to the cyclic movement of an object around a fixed point or fixed axis. The verb of rotation is to rotate.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

Threaded Connection: As used in this disclosure, a threaded connection is a type of fastener that is used to join a first cylindrical object and a second cylindrical object together. The first cylindrical object is fitted with a first fitting selected from an interior screw thread or an exterior screw thread. The second cylindrical object is fitted with the remaining screw thread. The cylindrical object fitted with the exterior screw thread is placed into the remaining cylindrical object such that: 1) the interior screw thread and the exterior screw thread interconnect; and, 2) when the cylindrical object fitted with the exterior screw thread is rotated the rotational motion is converted into linear motion that moves the cylindrical object fitted with the exterior screw thread either into or out of the remaining cylindrical object. The direction of linear motion is determined by the direction of rotation.

Tube: As used in this disclosure, the term tube is used to describe a hollow prism-shaped device with two congruent open ends. While tubes that are suitable for use in this disclosure are often used to transport or conveys fluids or gases, the purpose of the tubes in this disclosure are structural. In this disclosure, the terms inner dimension and outer dimension of a tube are used as they would be used by those skilled in the plumbing arts.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will H readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A dumbbell comprising a center shaft, a plurality of weight plates, a plurality of collar plates, and a plurality of end caps;

wherein the plurality of weight plates, the plurality of collar plates, and the plurality of end caps attach to the center shaft;

wherein the center shaft comprises a first congruent end and a second congruent end;

wherein the first congruent end further comprises a first interior screw thread and a first exterior screw thread;

wherein the second congruent end further comprises a second interior screw thread and a second exterior screw thread;

wherein the first congruent end is a congruent end of a prism shaped structure of the center shaft;
wherein the first interior screw thread is a prism shaped negative space that is formed in the first congruent end;
wherein the first interior screw thread forms a composite prism structure within the center shaft;
wherein the first exterior screw thread is a helical structure that is formed on a lateral face of the prism shaped structure of the center shaft;
wherein the first exterior screw thread aligns with the first congruent end of the center shaft;
wherein the second congruent end is a congruent end of the prism shaped structure of the center shaft;
wherein the second interior screw thread is a prism shaped negative space that is formed in the second congruent end;
wherein the second interior screw thread forms a composite prism structure within the center shaft;
wherein the second exterior screw thread is a helical structure that is formed on a lateral face of the prism shaped structure of the center shaft;
wherein the second exterior screw thread aligns with the second congruent end of the center shaft.

2. The dumbbell according to claim 1
wherein the center shaft, the plurality of weight plates, the plurality of collar plates, and the plurality of end caps are interconnected using threaded connections;
wherein the plurality of collar plates and the plurality of end caps secure the plurality of weight plates into a fixed position on the center shaft.

3. The dumbbell according to claim 2
wherein the center shaft is a prism shaped structure;
wherein the center shaft is a rigid structure;
wherein the center shaft is a load bearing structure.

4. The dumbbell according to claim 3
wherein the plurality of weight plates comprises a collection of individual weight plates;
wherein each individual weight plate selected from the plurality of weight plates is a disk shaped structure;
wherein each selected individual weight plate is a rigid structure;
wherein each selected individual weight plate forms a mass;
wherein each selected individual weight plate is a ring shaped structure;
wherein each selected individual weight plate slides onto the center shaft;
wherein each selected individual weight plate forms an interchangeable mass that attaches to the center shaft.

5. The dumbbell according to claim 4
wherein each collar plate collar plates is a disk shaped structure;
wherein each selected collar plate is a rigid structure;
wherein each selected collar plate forms a physical barrier that prevents the plurality of weight plates from shifting its position along the center shaft;
wherein each selected collar plate is a ring shaped structure;
wherein each selected collar plate screws onto the center shaft.

6. The dumbbell according to claim 5
wherein each end cap selected from the plurality of end caps is a composite prism structure;
wherein each selected end cap is a rigid structure;
wherein each selected end cap forms a physical barrier that prevents the plurality of weight plates from shifting off of the center shaft;
wherein each selected end cap screws onto a congruent end of the center shaft.

7. The dumbbell according to claim 6
wherein each selected individual weight plate is further defined with a plate ring;
wherein the plate ring forms the disk shaped structure of the selected individual weight plate;
wherein the plate ring is a rigid structure;
wherein the plate ring has a ring shape;
wherein the plate ring forms the mass of the selected individual weight plate;
wherein the plate ring slides onto a congruent end of the center shaft selected from the group consisting of the first congruent end and the second congruent end;
wherein the plate ring further comprises a plate aperture;
wherein the plate aperture is a prism shaped negative space that is formed through the congruent ends of the disk shaped structure of the plate ring;
wherein the plate aperture forms the negative space within the plate ring that is characteristic of a ring structure;
wherein the plate aperture has a prism shaped negative space.

8. The dumbbell according to claim 7
wherein the plurality of collar plates comprises a first collar plate and a second collar plate;
wherein the first collar plate is a disk shaped structure;
wherein the first collar plate is a rigid structure;
wherein the first collar plate has a ring shape;
wherein the first collar plate screws onto the first congruent end of the center shaft;
wherein the first collar plate forms a physical barrier that prevents an individual weight plate from shifting its position along the center shaft;
wherein the second collar plate is a disk shaped structure;
wherein the second collar plate is a rigid structure;
wherein the second collar plate has a ring shape;
wherein the second collar plate screws onto the second congruent end of the center shaft;
wherein the second collar plate forms a physical barrier that prevents an individual weight plate from shifting its position along the center shaft.

9. The dumbbell according to claim 8
wherein the plurality of end caps comprises a first end cap and a second end cap;
wherein the first end cap is a rigid structure;
wherein the first end cap forms a physical barrier that prevents the individual weight plate from shifting off of the first congruent end of the center shaft;
wherein the second end cap is a rigid structure;
wherein the second end cap forms a physical barrier that prevents the individual weight plate from shifting off of the second congruent end of the center shaft.

10. The dumbbell according to claim 9
wherein the first collar plate comprises a first collar plate ring, a first collar plate aperture, and a first collar plate interior screw thread;
wherein the first collar plate interior screw thread is formed in the first collar plate aperture;
wherein the first collar plate ring forms the disk shaped structure of the first collar plate;
wherein the first collar plate ring is a rigid structure;
wherein the first collar plate ring has a ring shape;
wherein the first collar plate ring screws onto the first congruent end of the center shaft;

wherein the first collar plate aperture is a prism shaped negative space that is formed through the congruent ends of the disk shaped structure of the first collar plate ring;

wherein the first collar plate interior screw thread is a helical structure that is formed on a lateral face of the prism shaped negative space formed by the first collar plate aperture;

wherein the first collar plate interior screw thread is sized such that the first collar plate can screw directly onto the center shaft.

11. The dumbbell according to claim 10 wherein the second collar plate comprises a second collar plate ring, a second collar plate aperture, and a second collar plate interior screw thread;

wherein the second collar plate interior screw thread is formed in the second collar plate aperture;

wherein the second collar plate ring forms the disk shaped structure of the second collar plate;

wherein the second collar plate ring is a rigid structure;

wherein the second collar plate ring has a ring shape;

wherein the second collar plate ring screws onto the second congruent end of the center shaft;

wherein the second collar plate aperture is a prism shaped negative space that is formed through the congruent ends of the disk shaped structure of the second collar plate ring;

wherein the second collar plate interior screw thread is a helical structure that is formed on a lateral face of the prism shaped negative space formed by the second collar plate aperture;

wherein the second collar plate interior screw thread is sized such that the second collar plate can screw directly onto the center shaft.

12. The dumbbell according to claim 11 wherein the first end cap further comprises a first cap disk, a first cap fastener, and a first cap guide;

wherein the first cap disk is a disk shaped structure;

wherein the first cap disk is a rigid structure;

wherein a span of a length of an outer diameter of the first cap disk is greater than a span of a length of an outer diameter of the first congruent end of the center shaft such that the first cap disk encloses the first congruent end;

wherein the first cap fastener is a prism shaped structure;

wherein the first cap fastener attaches to a congruent end of the disk shaped structure of the first cap disk;

wherein the first cap fastener attaches to the first cap disk to form a composite prism shaped structure;

wherein a lateral face of the prism structure of the first cap fastener is formed with an exterior screw thread;

wherein the first cap fastener is sized such that the first cap fastener forms a threaded connection with the first interior screw thread of the first congruent end;

wherein the first cap fastener screws the first end cap to the first congruent end;

wherein the first cap guide is a prism shaped structure;

wherein the first cap guide is a rigid structure;

wherein the first cap guide attaches to a congruent end of the prism shaped structure of the first cap fastener that is distal from the first cap disk;

wherein the first cap guide attaches to the first cap fastener to form a composite prism structure;

wherein the first cap guide forms a leading structure that is used to guide the first end cap into the first interior screw thread of the first congruent end.

13. The dumbbell according to claim 12 wherein the second end cap further comprises a second cap disk, a second cap fastener, and a second cap guide;

wherein the second cap disk is a disk shaped structure;

wherein the second cap disk is a rigid structure;

wherein a span of a length of an outer diameter of the second cap disk is greater than a span of a length of an outer diameter of the second congruent end of the center shaft such that the second cap disk encloses the second congruent end;

wherein the second cap fastener is a prism shaped structure;

wherein the second cap fastener attaches to a congruent end of the disk shaped structure of the second cap disk;

wherein the second cap fastener attaches to the second cap disk to form a composite prism shaped structure;

wherein a lateral face of the prism shaped structure of the second cap fastener is formed with an exterior screw thread;

wherein the second cap fastener is sized such that the second cap fastener forms a threaded connection with the second interior screw thread of the second congruent end;

wherein the second cap fastener screws the second end cap to the second congruent end;

wherein the second cap guide is a prism shaped structure;

wherein the second cap guide is a rigid structure;

wherein the second cap guide attaches to a congruent end of the prism shaped second cap fastener that is distal from the second cap disk;

wherein the second cap guide attaches to the second cap fastener to form a composite prism structure;

wherein the second cap guide forms a leading structure that is used to guide the second end cap into the second interior screw thread of the second congruent end.

* * * * *